US007119498B2

(12) United States Patent
Baldwin et al.

(10) Patent No.: US 7,119,498 B2
(45) **Date of Patent: *Oct. 10, 2006**

(54) CURRENT CONTROL DEVICE FOR DRIVING LED DEVICES

(75) Inventors: David J. Baldwin, Allen, TX (US); Sanmukh Patel, Richardson, TX (US)

(73) Assignee: Texas Instruments Incorporated, Dallas, TX (US)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 107 days.

(21) Appl. No.: 11/012,793

(22) Filed: Dec. 14, 2004

(65) Prior Publication Data

US 2005/0140315 A1 Jun. 30, 2005

Related U.S. Application Data

(60) Provisional application No. 60/533,773, filed on Dec. 29, 2003.

(51) Int. Cl.
*G05F 1/00* (2006.01)

(52) U.S. Cl. ..... 315/291; 315/307; 315/224; 315/169.1; 315/185 R; 340/815.45; 340/636.18

(58) Field of Classification Search ..... 315/291, 315/307, 224, 185 R, 169.1, 169.3; 340/815.45, 340/636.16, 636.18; 345/108; 326/82, 83; 362/800

See application file for complete search history.

(56) References Cited

U.S. PATENT DOCUMENTS

| | | | | |
|---|---|---|---|---|
| 3,755,697 | A * | 8/1973 | Miller | 327/109 |
| 6,144,222 | A * | 11/2000 | Ho | 326/82 |
| 6,400,101 | B1 * | 6/2002 | Biebl et al. | 315/291 |
| 7,038,594 | B1 * | 5/2006 | Voreis et al. | 340/815.45 |
| 2005/0104542 | A1 * | 5/2005 | Ito et al. | 315/291 |

* cited by examiner

*Primary Examiner*—Haissa Philogene
(74) *Attorney, Agent, or Firm*—Alan K. Stewart; W. James Brady; Frederick J. Telecky, Jr.

(57) ABSTRACT

A current control device for driving LED devices uses a switched-mode current control loop inside of an output intensity low-frequency pulse width modulation (PWM) control loop. This allows separate control of current level (for accurate light wavelength output) and light intensity. The current control device requires only one switch to regulate current level, and no other switches for the intensity control. This allows lower parts count for greater reliability and lower system cost.

10 Claims, 2 Drawing Sheets

22
SLAVE EXTENSION
Rmeas
Master2
Rshunt
Rshunt
Master1
26
680uH
28
30
C
20
Rol
CB
Vclk
Vsrc
LEDC1
LEDC2
Vmeas
Vol
Gnd
Rcomp
V-
Ccomp
Vcomp
LED CONTROLLER
Vcc
Rbias
Vf
RT100
RNorm
RGrad
Vset
Enable
Vst
LFosc
35
24
32
34
Rset
36
Cosc
33
Vbattery
REFERENCE LED

CURRENT CONTROL DEVICE FOR DRIVING LED DEVICES

This application claims priority under 35 USC § 119 (e) (1) of provisional application No. 60/533,773 filed Dec. 29, 2003.

FIELD OF THE INVENTION

The present invention relates to electronic circuitry and, in particular, to a current control device for driving LED devices.

SUMMARY OF THE INVENTION

A current control device for driving LED devices uses a switched-mode current control loop inside of an output intensity low-frequency pulse width modulation (PWM) control loop. This allows separate control of current level (for accurate light wavelength output) and light intensity. The current control device requires only one switch to regulate current level, and no other switches for the intensity control. This allows lower parts count for greater reliability and lower system cost.

DETAILED DESCRIPTION OF PREFERRED EMBODIMENTS

Figure 1:
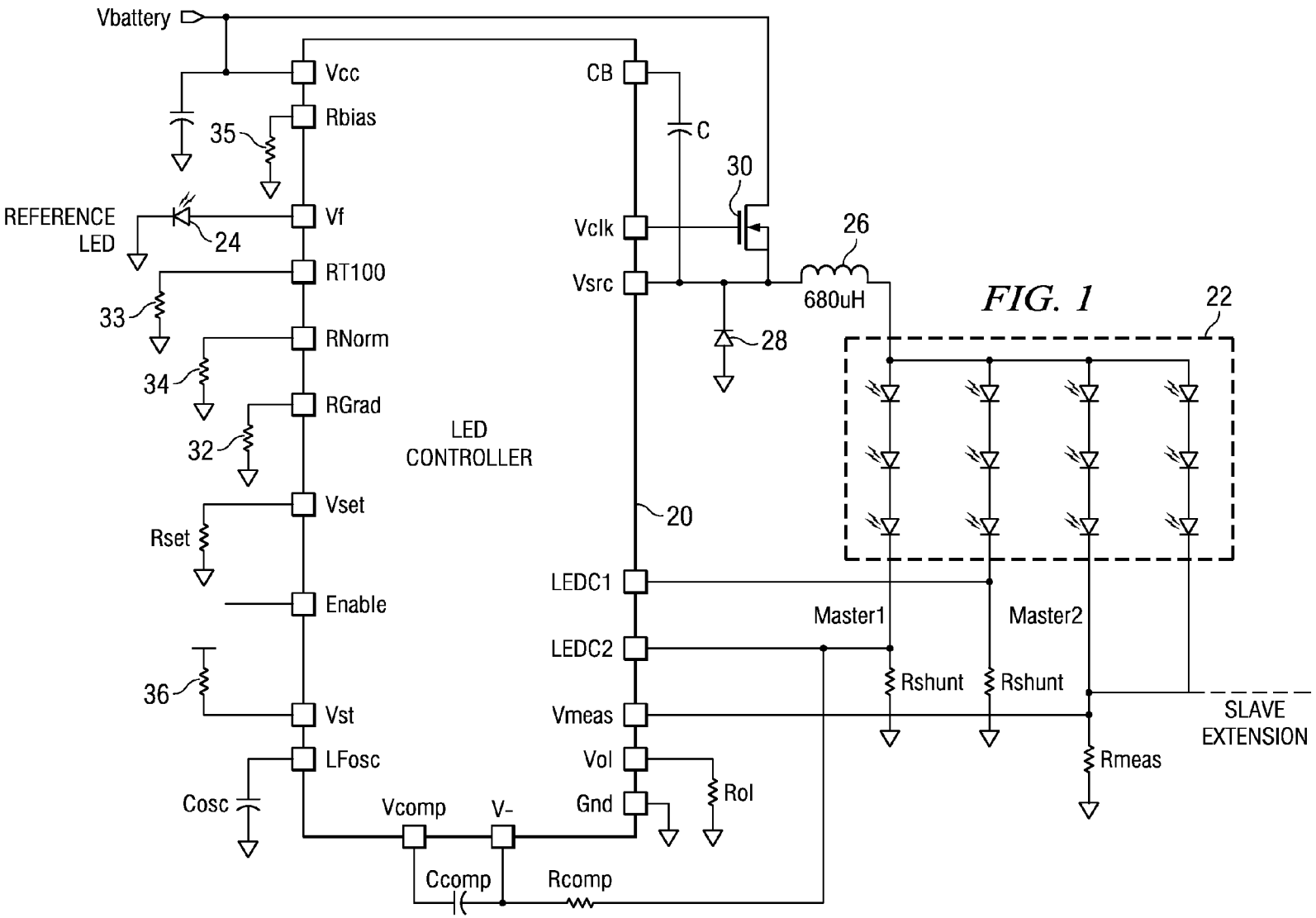
FIG. 1 is a diagram of a preferred embodiment light emitting diode (LED) current controller and LED device.

A preferred embodiment light emitting diode (LED) current controller and LED device is shown in FIG. 1. The device of FIG. 1 includes LED controller 20; LEDs 22; reference LED 24, inductor 26, diode 28, transistor 30 (FET), resistor nodes Rshunt1, Rshunt2, Rmeas, Rbias, RT100, RNorm, RGad, Rol, Rcomp; capacitors Cosc, Ccomp, C1, and C2; LED controller nodes Vcc, Vf, Vset, Enable, VST, LFosc, Vcomp, V−, Gnd, Vol, Vmeas, LEDC1, LEDC2, Vsrc, Vclk, and CB; and supply node Vbattery. The current through the load 22 (LEDs) is set by the resistors Rshunt1 and Rshunt2 in the Master strings Master 1 and Master 2. An external resistor Rset on pin Vset sets the peak current through the load 22. This topology is a switch mode hysteric control method. The ripple current on the output is set by an internal control loop (a window comparator). This control loop will maintain an average current through the load (LED IF) with minimum ripple (TBD). This is an asynchronous configuration with external passive devices (FET 30, re-circulation diode 28, and inductor 26).

Figure 2:
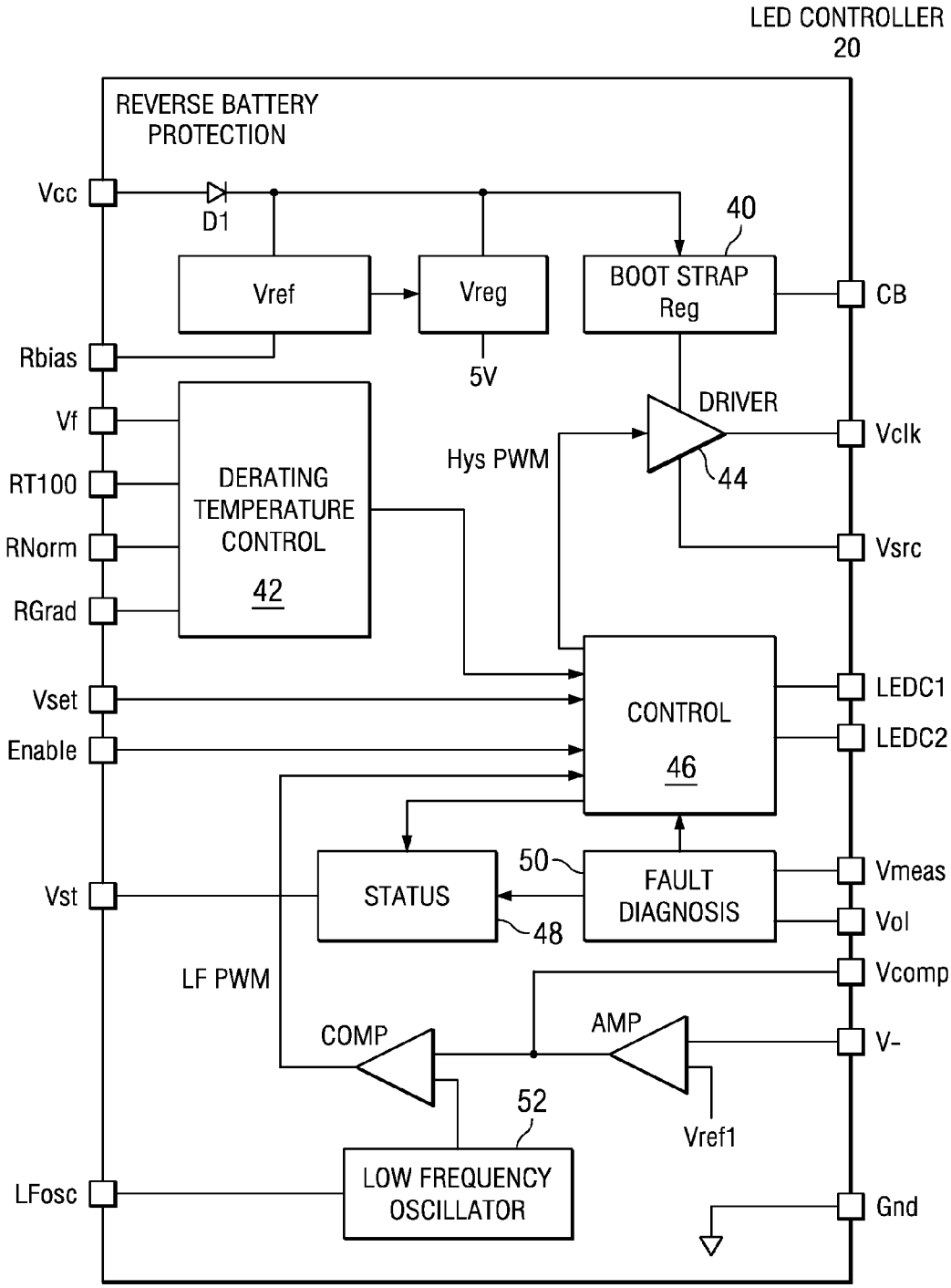
FIG. 2 is a diagram of the LED controller of FIG. 1.

A diagram of the LED controller 20 of FIG. 1 is shown in FIG. 2. The device of FIG. 2 includes voltage reference generator Vref; voltage regulator Vreg; boot strap regulator 40; derating temperature control 42; driver 44; control device 46; status generator 48; fault diagnosis 50; comparator Comp; amplifier amp; low frequency oscillator 52; reference voltage Vref1; and reverse battery protection diode D1.

Setting a reference on pin Vf compensates for the variation in LED forward current due to changes in ambient temperature. Resistor 32 at node Rgrad sets the value for LED current deration with increase in ambient temperature.

Resistor 33 at node RT100 provides a reference for switching off the LED current if the ambient temperature exceeds 100° C. This provision is required to extend the LED life.

Resistor 34 at node RNorm has two functions in the system. Firstly, this is a point of reference for switch over between the independent and dependent current control. Secondly, it provides the adjustment to the LED forward current set at pin Vset. Resistor 35 at node Rbias is required to set a precision current bias for internal reference settings.

Node Vst is an open collector output and requires an external pull up resistor 36 to supply. This is a status pin for any diagnostic faults in the system. A fault in LED string Master1 will de detected and indicated by output node Vst, and the system will automatically switch to the next LED string Master 2.

Low Frequency Intensity Control

The low frequency oscillator, integrator Amp and comparator Comp form low frequency pulse width modulation (PWM) intensity control loops. The LED current is integrated by the amplifier Amp and external RC components Ccomp and Rcomp, allowing independent control of the intensity of the LED. Capacitor Cosc on node LFosc determines the low frequency operation of the intensity control system.

The advantages of the present invention are provided by the use of a switched-mode current control loop inside of an output intensity low-frequency PWM control loop. This allows separate control of current level (for accurate light wavelength output) and light intensity. Prior art solutions use boost-derived voltage regulation to control current level, with separate pass switches to control intensity by PWM. The present invention requires only one switch to regulate current level, and no other switches for the intensity control. This allows lower parts count for greater reliability and lower system cost.

While this invention has been described with reference to an illustrative embodiment, this description is not intended to be construed in a limiting sense. Various modifications and combinations of the illustrative embodiment, as well as other embodiments of the invention, will be apparent to persons skilled in the art upon reference to the description. It is therefore intended that the appended claims encompass any such modifications or embodiments.

What is claimed is:

1. A device for driving light emitting diodes comprising:

an integrator coupled to a first LED current node;

a comparator having a first input coupled to the integrator;

an oscillator coupled to a second input of the comparator;

a control device having a first input coupled to the comparator and for providing a hysteretic pulse width modulated signal on an output node of the control device;

a temperature control device coupled to a second input of the control device for setting a value for LED current deration with increase in ambient temperature;

a driver having an input coupled to the output of the control device;

a driver transistor having a control node coupled to an output of the driver; and an inductor coupled between the driver transistor and a second LED current node.

2. The device of claim 1 further comprising a regulator coupled to a first source node of the driver.

3. The device of claim 2 further comprising a second source node of the driver coupled to a node between the driver transistor and the inductor.

4. The device of claim 3 further comprising a capacitor coupled between the second source node of the driver and the regulator.

5. The device of claim 2 wherein the regulator is a boot strap regulator.

6. The device of claim 1 further comprising a fault diagnosis device having an input coupled to a LED slave string node and a first output coupled to the control device.

7. The device of claim 6 further comprising a status device having a first input coupled to the fault diagnosis device and a second input coupled to the control device.

8. The device of claim 7 wherein the status device provides an output for indicating diagnostic faults.

9. The device of claim 1 further comprising a capacitor coupled to the oscillator for controlling low frequency operation.

10. The device of claim 1 further comprising a recirculation diode coupled to the driver transistor and the inductor.

* * * * *